US009820033B2

(12) United States Patent
Dix et al.

(10) Patent No.: US 9,820,033 B2
(45) Date of Patent: Nov. 14, 2017

(54) SPEAKER ASSEMBLY

(71) Applicant: Apple Inc., Cupertino, CA (US)

(72) Inventors: Gordon R. Dix, Sunnyvale, CA (US); Michael K. Morishita, Belmont, CA (US)

(73) Assignee: Apple Inc., Cupertino, CA (US)

( * ) Notice: Subject to any disclaimer, the term of this patent is extended or adjusted under 35 U.S.C. 154(b) by 829 days.

(21) Appl. No.: 13/630,542

(22) Filed: Sep. 28, 2012

(65) Prior Publication Data

US 2014/0093113 A1 Apr. 3, 2014

(51) Int. Cl.
*H04R 1/28* (2006.01)
*H04R 1/02* (2006.01)

(52) U.S. Cl.
CPC ..... *H04R 1/2826* (2013.01); *H04R 1/023* (2013.01); *H04R 1/026* (2013.01); *H04R 2201/029* (2013.01); *H04R 2499/15* (2013.01); *Y10T 29/49826* (2015.01)

(58) Field of Classification Search
None
See application file for complete search history.

(56) References Cited

U.S. PATENT DOCUMENTS

| | | | |
|---|---|---|---|
| 1,276,708 | A | 8/1918 | Blair |
| 1,646,628 | A | 10/1927 | Nolen |
| 1,893,291 | A | 1/1933 | Kwartin |
| 1,992,605 | A | 2/1935 | Clifford et al. |
| 2,325,688 | A | 7/1943 | Landis |
| 2,779,095 | A | 1/1957 | Hottenroth, Jr. |
| 3,414,689 | A | 12/1968 | Gummel et al. |

(Continued)

FOREIGN PATENT DOCUMENTS

| | | |
|---|---|---|
| CN | 204104134 | 1/2015 |
| EP | 2094032 | 8/2009 |

(Continued)

OTHER PUBLICATIONS

Blankenbach et al., "Bistable Electrowetting Displays," https://spie.org/x43687.xml, 3 pages, Jan. 3, 2011.

(Continued)

*Primary Examiner* — Curtis Kuntz
*Assistant Examiner* — Kenny Truong
(74) *Attorney, Agent, or Firm* — Kilpatrick Townsend & Stockton LLP

(57) ABSTRACT

Examples of speaker assemblies are described. A speaker assembly according to some embodiments may include a speaker enclosure with a first opening (e.g., a speaker opening) and a second opening (e.g. a bass reflex port), a speaker unit mounted to the enclosure at the first opening, and an acoustic damping mechanism mounted to the enclosure at the second opening. The acoustic damping mechanism may be a dual-layer mesh screen including a first mesh with a first acoustic resistance (AR) for providing acoustic damping, and a second mesh with a second AR lower than the first AR. The second mesh may be nearly acoustically transparent and may serve to increase the stiffness of the first mesh. The first mesh may be bonded to the second mesh, and the dual-layer mesh screen may be coupled to the bass reflex port for reducing noise associated with turbulence at the port.

18 Claims, 6 Drawing Sheets

(56) References Cited

U.S. PATENT DOCUMENTS

| | | | | |
|---|---|---|---|---|
| 3,866,299 | A | 2/1975 | Gregg et al. | |
| 4,068,103 | A | 1/1978 | King et al. | |
| 4,081,631 | A | 3/1978 | Feder | |
| 4,089,576 | A | 5/1978 | Barchet | |
| 4,132,437 | A | 1/1979 | Green | |
| 4,245,642 | A | 1/1981 | Skubitz et al. | |
| 4,466,441 | A | 8/1984 | Skubitz et al. | |
| 4,658,425 | A | 4/1987 | Julstrom | |
| 5,106,318 | A | 4/1992 | Endo et al. | |
| 5,293,002 | A | 3/1994 | Grenet et al. | |
| 5,335,011 | A | 8/1994 | Addeo et al. | |
| 5,406,038 | A | 4/1995 | Reiff et al. | |
| 5,521,886 | A | 5/1996 | Hirosawa et al. | |
| 5,570,324 | A | 10/1996 | Geil | |
| 5,604,329 | A | 2/1997 | Kressner et al. | |
| 5,619,583 | A | 4/1997 | Page et al. | |
| 5,733,153 | A | 3/1998 | Takahashi et al. | |
| 5,879,598 | A | 3/1999 | McGrane | |
| 5,958,203 | A | 9/1999 | Parce et al. | |
| 6,036,554 | A | 3/2000 | Koeda et al. | |
| 6,073,033 | A | 6/2000 | Campo | |
| 6,129,582 | A | 10/2000 | Wilhite et al. | |
| 6,151,401 | A | 11/2000 | Annaratone | |
| 6,154,551 | A | 11/2000 | Frenkel | |
| 6,192,253 | B1 | 2/2001 | Charlier et al. | |
| 6,317,237 | B1 | 11/2001 | Nakao et al. | |
| 6,370,005 | B1 | 4/2002 | Sun et al. | |
| 6,400,825 | B1 | 6/2002 | Miyamoto et al. | |
| 6,516,077 | B1 | 2/2003 | Yamaguchi et al. | |
| 6,553,126 | B2 | 4/2003 | Han et al. | |
| 6,700,987 | B2 | 3/2004 | Kuze et al. | |
| 6,813,218 | B1 | 11/2004 | Antonelli et al. | |
| 6,829,018 | B2 | 12/2004 | Lin et al. | |
| 6,882,335 | B2 | 4/2005 | Saarinen | |
| 6,892,850 | B2 | 5/2005 | Suzuki et al. | |
| 6,924,792 | B1 | 8/2005 | Jessop | |
| 6,934,394 | B1 | 8/2005 | Anderson | |
| 6,942,771 | B1 | 9/2005 | Kayyem | |
| 7,003,099 | B1 | 2/2006 | Zhang et al. | |
| 7,059,932 | B1 | 6/2006 | Tobias et al. | |
| 7,082,322 | B2 | 7/2006 | Harano | |
| 7,116,795 | B2 | 10/2006 | Tuason et al. | |
| 7,142,683 | B1 * | 11/2006 | Markow | H04R 1/025 361/679.02 |
| 7,154,526 | B2 | 12/2006 | Foote et al. | |
| 7,158,647 | B2 | 1/2007 | Azima et al. | |
| 7,181,030 | B2 | 2/2007 | Rasmussen et al. | |
| 7,263,373 | B2 | 8/2007 | Mattisson | |
| 7,266,189 | B1 | 9/2007 | Day | |
| 7,362,877 | B2 | 4/2008 | Honda et al. | |
| 7,378,963 | B1 | 5/2008 | Begault et al. | |
| 7,527,523 | B2 | 5/2009 | Yohn et al. | |
| 7,536,029 | B2 | 5/2009 | Choi et al. | |
| 7,570,772 | B2 | 8/2009 | Sorensen et al. | |
| 7,679,923 | B2 | 3/2010 | Inagaki et al. | |
| 7,792,320 | B2 | 9/2010 | Proni | |
| 7,867,001 | B2 | 1/2011 | Ambo et al. | |
| 7,878,869 | B2 | 2/2011 | Murano et al. | |
| 7,903,061 | B2 | 3/2011 | Zhang et al. | |
| 7,912,242 | B2 | 3/2011 | Hikichi | |
| 7,966,785 | B2 | 6/2011 | Zadesky et al. | |
| 8,031,853 | B2 | 10/2011 | Bathurst et al. | |
| 8,055,003 | B2 | 11/2011 | Mittleman et al. | |
| 8,116,505 | B2 | 2/2012 | Kawasaki-Hedges et al. | |
| 8,116,506 | B2 | 2/2012 | Kuroda et al. | |
| 8,161,890 | B2 | 4/2012 | Wang | |
| 8,204,266 | B2 | 6/2012 | Munoz et al. | |
| 8,218,397 | B2 | 7/2012 | Chan | |
| 8,226,446 | B2 | 7/2012 | Kondo et al. | |
| 8,264,777 | B2 | 9/2012 | Skipor et al. | |
| 8,286,319 | B2 | 10/2012 | Stolle et al. | |
| 8,340,312 | B2 | 12/2012 | Johnson et al. | |
| 8,409,417 | B2 | 4/2013 | Wu | |
| 8,417,298 | B2 | 4/2013 | Mittleman et al. | |
| 8,447,054 | B2 | 5/2013 | Bharatan et al. | |
| 8,452,037 | B2 | 5/2013 | Filson et al. | |
| 8,488,817 | B2 | 7/2013 | Mittleman et al. | |
| 8,508,908 | B2 | 8/2013 | Jewell-Larsen | |
| 8,560,309 | B2 | 10/2013 | Pance et al. | |
| 8,574,004 | B1 | 11/2013 | Tarchinski et al. | |
| 8,620,162 | B2 | 12/2013 | Mittleman | |
| 8,632,670 | B2 | 1/2014 | Garimella et al. | |
| 8,644,533 | B2 | 2/2014 | Burns | |
| 8,724,841 | B2 | 5/2014 | Bright et al. | |
| 8,983,097 | B2 | 3/2015 | Dehe et al. | |
| 9,066,172 | B2 | 6/2015 | Nguyen et al. | |
| 9,161,434 | B2 | 10/2015 | Merz et al. | |
| 9,227,189 | B2 | 1/2016 | Sobek et al. | |
| 9,229,494 | B2 | 1/2016 | Rayner | |
| 2003/0087292 | A1 | 5/2003 | Chen et al. | |
| 2004/0203520 | A1 | 10/2004 | Schirtzinger et al. | |
| 2005/0009004 | A1 | 1/2005 | Xu et al. | |
| 2005/0271216 | A1 | 12/2005 | Lashkari | |
| 2006/0072248 | A1 | 4/2006 | Watanabe et al. | |
| 2007/0012827 | A1 | 1/2007 | Fu et al. | |
| 2007/0230723 | A1 * | 10/2007 | Hobson | H01R 13/748 381/300 |
| 2008/0204379 | A1 | 8/2008 | Perez-Noguera | |
| 2008/0260188 | A1 | 10/2008 | Kim | |
| 2008/0292112 | A1 | 11/2008 | Valenzuela et al. | |
| 2008/0310663 | A1 | 12/2008 | Shirasaka et al. | |
| 2009/0045005 | A1 | 2/2009 | Byon et al. | |
| 2009/0274315 | A1 | 11/2009 | Carnes et al. | |
| 2010/0062627 | A1 | 3/2010 | Ambo et al. | |
| 2011/0002487 | A1 | 1/2011 | Panther et al. | |
| 2012/0045081 | A1 * | 2/2012 | Mittleman | H04M 1/035 381/334 |
| 2012/0082317 | A1 | 4/2012 | Pance et al. | |
| 2012/0177237 | A1 | 7/2012 | Shukla et al. | |
| 2012/0247866 | A1 * | 10/2012 | Lage | H04R 1/2826 181/196 |
| 2012/0250928 | A1 | 10/2012 | Pance et al. | |
| 2012/0263019 | A1 | 10/2012 | Armstong-Muntner | |
| 2013/0017738 | A1 | 1/2013 | Asakuma et al. | |
| 2013/0051601 | A1 | 2/2013 | Hill et al. | |
| 2013/0129122 | A1 | 5/2013 | Johnson et al. | |
| 2013/0164999 | A1 | 6/2013 | Ge et al. | |
| 2013/0259281 | A1 | 10/2013 | Filson et al. | |
| 2013/0280965 | A1 | 10/2013 | Kojyo | |
| 2013/0308809 | A1 * | 11/2013 | Thompson | H04R 1/2834 381/332 |
| 2013/0343594 | A1 * | 12/2013 | Howes | H04R 1/1016 381/380 |
| 2014/0105440 | A1 | 4/2014 | Mittleman et al. | |
| 2014/0113478 | A1 | 4/2014 | Yeung et al. | |
| 2014/0140558 | A1 | 5/2014 | Kwong | |
| 2014/0226826 | A1 | 8/2014 | Utterman et al. | |
| 2014/0250657 | A1 | 9/2014 | Stanley et al. | |
| 2015/0078611 | A1 | 3/2015 | Boozer et al. | |
| 2015/0326959 | A1 | 11/2015 | Zadesky et al. | |

FOREIGN PATENT DOCUMENTS

| | | |
|---|---|---|
| GB | 2310559 | 8/1997 |
| GB | 2342802 | 4/2000 |
| JP | 2102905 | 4/1990 |
| JP | 2003319490 | 11/2003 |
| JP | 2004153018 | 5/2004 |
| JP | 2006297828 | 11/2006 |
| WO | WO03/049494 | 6/2003 |
| WO | WO2004/025938 | 3/2004 |
| WO | WO2007/083894 | 7/2007 |
| WO | WO2008/153639 | 12/2008 |
| WO | WO2009/017280 | 2/2009 |
| WO | WO2011/057346 | 5/2011 |
| WO | WO2011/061483 | 5/2011 |

OTHER PUBLICATIONS

Baechtle et al., "Adjustable Audio Indicator," IBM, 2 pages, Jul. 1, 1984.

Pingali et al., "Audio-Visual Tracking for Natural Interactivity,"

(56) References Cited

OTHER PUBLICATIONS

Bell Laboratories, Lucent Technologies, pp. 373-382, Oct. 1999.
Zhou et al., "Electrostatic Graphene Loudspeaker," Applied Physics Letters, vol. 102, No. 223109, 5 pages, Dec. 6, 2012.
U.S. Appl. No. 13/654,943, filed Oct. 18, 2012, pending.
U.S. Appl. No. 13/679,721, filed Nov. 6, 2012, pending.
U.S. Appl. No. 13/802,460, filed Mar. 13, 2013, pending.
U.S. Appl. No. 14/027,808, filed Sep. 16, 2013, pending.

* cited by examiner

SPEAKER ASSEMBLY

TECHNICAL FIELD

The present disclosure relates generally to speaker assemblies, and more specifically to speakers with ported enclosures.

BACKGROUND

Electronic devices such as desktop computers, computer monitors, laptops, smart phones, mobile gaming devices, and the like, may include audio capability. Generally, audio enabled electronic devices may include one or more microphones for receiving sound inputs and/or one or more speakers for outputting sound.

Speakers may generally be enclosed within a speaker enclosure, which may be sealed or ported. As may be known, speakers generate two sets of pressure waves, one forward and one aft of the speaker cone. In this regard and as its name implies, a sealed enclosure (also referred to as a closed box) is an enclosure which isolates the forward pressure waves from the aft waves generated by the speaker. In contrast, a ported enclosure typically includes at least one opening which may enhance the power efficiency of the speaker assembly and/or may aid in the reproduction of low frequency sounds by extending the low frequency range of the speaker enclosure. Thus, speakers adapted for the reproduction of sound at lower audible frequencies (e.g. woofers) are generally enclosed in a ported enclosure. However, while ported enclosures may be generally known in the art, conventional ported enclosures and speaker assemblies with such conventional ported enclosures may have numerous shortcomings, some or all of which may be addressed by the examples described herein.

SUMMARY

A speaker assembly according to the present disclosure may include a speaker enclosure including a first opening and a second opening with a speaker unit mounted to the enclosure at the first opening and an acoustic damping mechanism mounted to the enclosure at the second opening. The acoustic damping mechanism may be mesh screen, the thickness, density and/or acoustic resistance properties of which may be varied, and which may, in some examples, be configured as a dual-layer mesh. That is, in some embodiments the mesh screen may include a first mesh and a second mesh, the first mesh bonded to the second mesh. The first mesh, which may be a fine mesh, may have a first acoustic resistance, which may range from about 16 Rayls to about 75 Rayls. The second mesh, which may be a coarser mesh, may have an acoustic resistance from about 1 Rayl to about 8 Rayls (e.g., the coarse mesh may be nearly acoustically transparent). In certain examples, the first or fine mesh may be selected to have an acoustic resistance of about 32 Rayls and the second or coarse mesh may be selected to have an acoustic resistance of about 8 Rayls.

In some examples, the first mesh may be made of a cloth material and the second mesh may be metallic. Other materials, for example a variety of polymers, may be used for the first and/or second mesh in other examples The second mesh may be formed from a plurality of metal wires, individual ones of which may have virtually any cross-section. In some examples, the metal wires may be circular, square, rectangular or other irregularly shaped cross sections, as may be desired. The cross sectional size and/or shape of the wires may be varied along a length of the wire to tailor the properties, for example the bending stiffness, of the mesh.

Electronic devices, such as audio generating device, display devices, and a variety of desktop, portable, or handheld computers may be implemented according to the examples herein to incorporate speaker assemblies as described. In some examples, an electronic device may include a speaker assembly, which include one or more speakers coupled to a speaker enclosure including a port and a mesh mounted across an opening of the port. The electronic device may further include circuitry for generating audio signals and transmitting the audio signals to the speaker. Additional circuitry, such as memory, processors, and display drivers may be included in certain electronic devices according to the present disclosure. The electronic device may also include a housing which substantially encloses the circuitry and the speaker assembly.

In some embodiments, the electronic device may include a first speaker assembly and a second speaker assembly, which may be implemented according to any of the examples herein. Speaker enclosures of one or more of the speaker assemblies may be regularly shaped (e.g. having a generally box shape) or may be irregularly shaped with the contours of the speaker enclosure being shaped to fit in a cooperating manner within the housing of the electronic device. For example, the housing may include a curved surface and the speaker enclosure of the speaker assembly may be mounted against the housing so as to define an enclosed space between the speakers of the assembly and the curved surface of the housing. Other combinations may be implemented, some of which will be described in further detail below.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings, in which:

DETAILED DESCRIPTION

Figure 1:
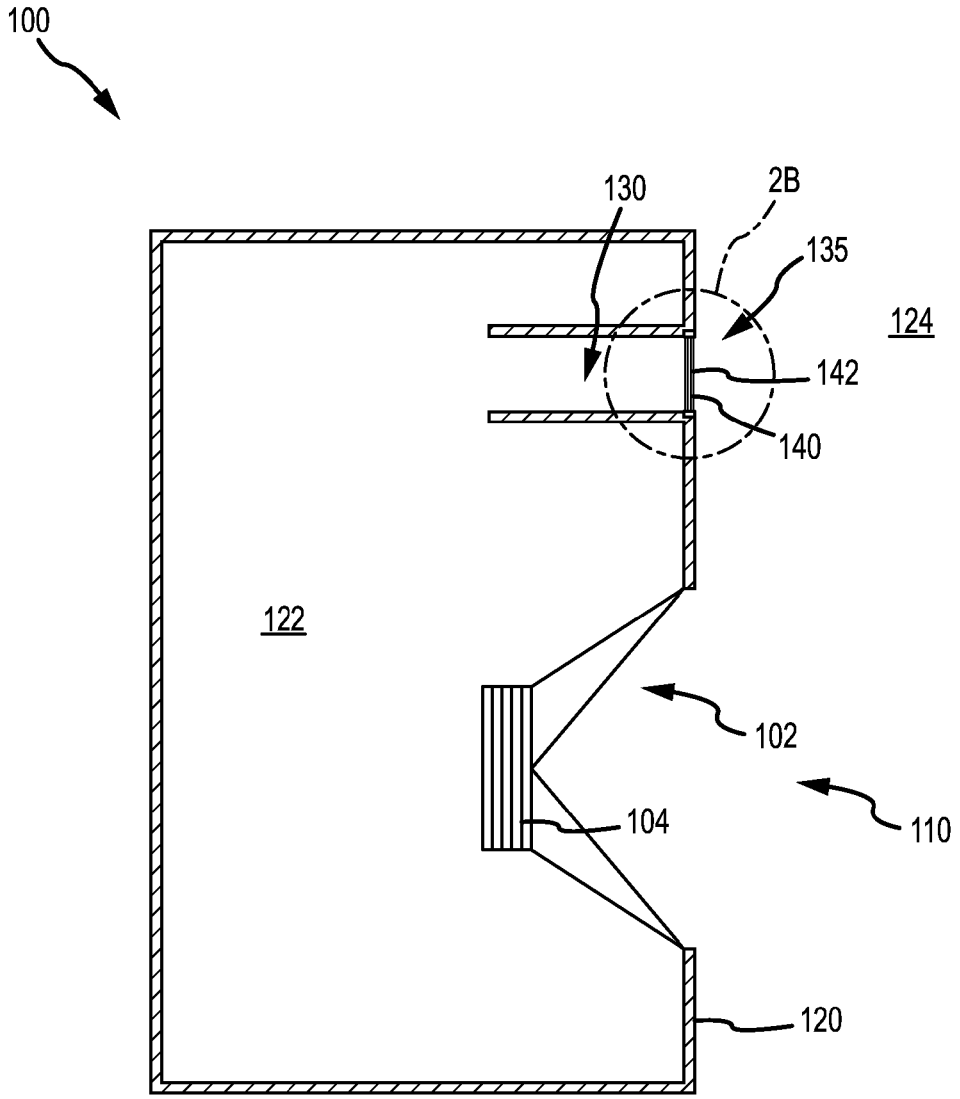
FIG. 1 is a simplified schematic cross-sectional illustration of a speaker assembly according to an example of the present disclosure.

In the following detailed description, reference is made to the accompanying drawings, which form a part hereof. In the drawings, similar symbols typically identify similar components, unless context dictates otherwise. The illustrative examples described in the detailed description, drawings, and claims are not meant to be limiting. Other examples may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

The present disclosure relates generally to speaker assemblies, and more specifically to speakers with ported enclosures. FIG. 1 shows a simplified schematic cross-sectional illustration of a speaker assembly according to one example of the present disclosure. The speaker assembly 100 may include a speaker or speaker unit 110 (e.g. the speaker cone 102 and driver 104), a speaker enclosure 120, and a port 130. As will be appreciated by those skilled in the art and as described above, the port 130 (also referred to as a vent or bass reflex port) couples the interior 122 and the exterior 124 of the enclosure 120, allowing the ambient medium, typically air, to flow in and out of the enclosure in response to pressure waves generated by the movement of the speaker cone 102. The port 130 may have an inlet 135 which may be circular, rectangular, triangular, or have virtually any other shape as may be desired or appropriate for the particular application.

In general, as the velocity of the air moving in or out of the port 130 increases, the turbulence of the airflow may also increase, resulting in undesirable noise. In some instances, undesirable turbulence may be reduced by shaping the inlet 135 to smooth air flow over the edges of the inlet. For example, in conventional speakers, the bass reflex port may be rounded at the inlet and/or outlet of the bass reflex port so as to minimize undesirable turbulence. However, tailoring the bass reflex port in this manner may not always be practical.

In the alternative or in combination with shaping the inlet and/or outlet, a damping mechanism 140 may be included at the inlet 135, which may slow down the flow of air and/or smooth out the airflow passing through the inlet of port 130. The damping mechanism 140 may, in some examples, be implemented as a mesh screen 142. The damping mechanism (e.g. mesh screen 142) may be placed across the inlet 135 substantially flush with exterior surfaces of the enclosure, or in other examples, the mesh screen 142 may be recessed within the port 135. The mesh screen 142 may include one or more layers, as will be further described.

Figure 2A:
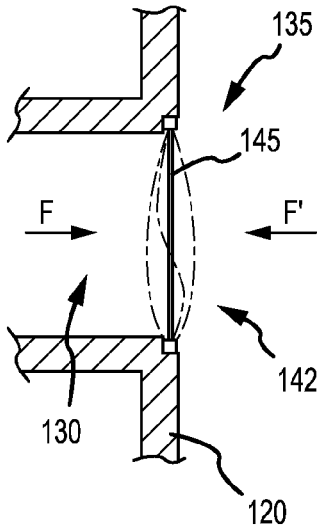
FIG. 2A is a simplified partial cross-sectional view of an inlet of a bass reflex port according to an example of the present disclosure.
Figure 2B:
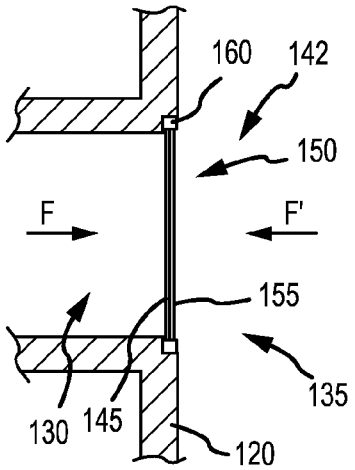
FIG. 2B is a simplified partial cross-sectional view of the inlet of the bass reflex port in FIG. 1
Figure 2C:
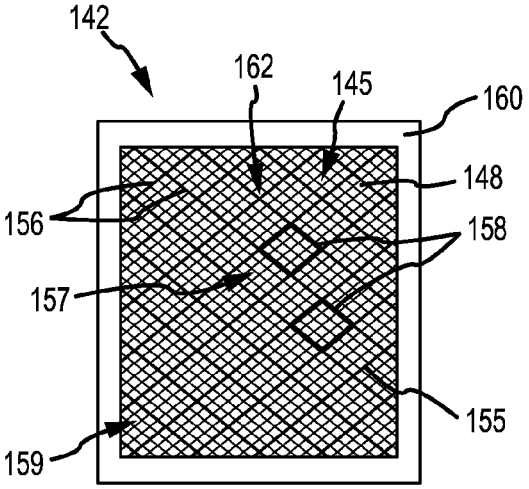
FIG. 2C is a front view of an example of a mesh screen according to the present disclosure.

Referring now to FIGS. 2A-2C, the mesh screen 142 may include a first mesh 145, which may be selected to have an acoustic resistance sufficient to provide a certain level of acoustic damping. Acoustic resistance, typically measured in Rayls, corresponds generally to the opposition to the flow of sound through an object. In the case of perforated materials (e.g. perforated plates, screens, mesh materials, and the like), the acoustic resistance may decrease as the density of the mesh or perforations decreases (e.g. the size of openings/perforations increases). In some examples, the first mesh 145 may be implemented as a finely woven cloth or fabric, for example a woven polyester, rayon, nylon or other type of cloth or a fabric including other types of polymeric or metallic fibers. The density of the first mesh 145 (also referred to herein as fine mesh) may be selected to result in an acoustic resistance of about 30 to about 40 Rayls. In some instances, the acoustic resistance of the fine mesh may be about 32 Rayls. As will be appreciated, the damping level may depend on many factors, for example the geometry of the enclosure and/or the bass reflex port, the types of drivers, and certain other performance factors. In this regard, the acoustic resistance of the mesh (e.g. first mesh 145) may be tailored as needed for the particular application. In some examples, the acoustic resistance of the fine mesh (e.g. first mesh 145) may range anywhere between 15 Rayls to about 75 Rayls.

While the first mesh 145 (e.g. fine mesh) may advantageously reduce turbulence at the inlet 135 (e.g. by slowing down the flow of air), the fine mesh may be prone to out of plane deflections (as shown in dashed lines in FIG. 2A) due to the pressure waves or airflow F, F'. The air may flow in directions across the inlet 135. Deflections of the mesh 145 caused by the airflow in and out of port 130 may cause audible noise and/or damage the fine mesh, for example resulting in tearing of the fine mesh. Furthermore, as the size of port 130 increases, different modes of vibration of the first mesh 145 (e.g. fine mesh) may be excited, which may cause noise to linger after the speakers are turned off.

To reduce or eliminate problems associated with out of plane deflections of the first mesh 154, a dual-layer mesh configuration may be implemented as described herein and shown in FIG. 2B. According to some embodiments, a stabilizing layer 150 may be included in the mesh screen 142. The stabilizing layer 150 may be implemented as a second mesh 155 which is less dense or coarser than the first mesh 145. In this regard, the second mesh 155 may also be interchangeably referred to as coarse mesh 155. The coarse mesh 155 may be disposed on either side of the fine mesh (e.g. first mesh 145). For example, it may be on the exterior side, or it may be on the opposite or interior side of the fine mesh. Because air travels in and out of the port 130, the placement of the coarse mesh 155 relative to either of the sides of the fine mesh may not affect the functionality of the mesh screen 142, and a particular location may, in some instances, be selected for aesthetic reasons.

The coarse mesh 155 may be formed from virtually any type of suitable material, such as aluminum, steel, or other metallic materials, ceramics, and plastics, and may be implemented according to a variety of form factors. In some examples, the coarse mesh 155 may be made of a rigid plastic material, such as polycarbonate/acrylonitrile butadiene styrene (PC/ABS) blend plastic, which may be configured to provide the desired stiffness in the out-of-plane direction. The coarse mesh 155 may be implemented from a flat sheet of material through which the openings are formed (e.g. a speaker grill configuration). The geometry of the openings 158 (see FIG. 2C) of the coarse mesh 155 may be circular, elongated, diamond-shaped, honeycomb or hexagonal, or virtually any other shape or combinations of shapes. In other examples, the mesh may be a woven or coil mesh, formed by weaving or otherwise interlocking strands of metallic or plastic material to define openings 158 of a certain shape and/or size. The density or type of weave may be selected to provide a particular stiffness and/or acoustic resistance, as may be desired or suitable for a particular application.

Figure 2D:
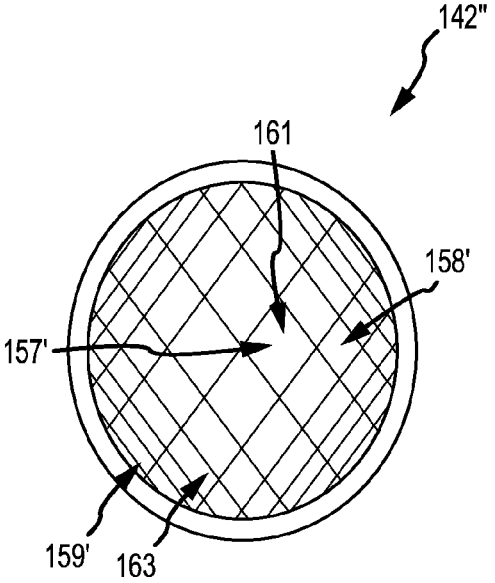
FIG. 2D is a front view of another example of a mesh screen according to the present disclosure.

FIG. 2C, which shows a front view of a mesh screen 140 according to one example of the present disclosure, depicts a coarse mesh 155 with generally rhomboid or diamond shaped openings. The fine mesh (e.g. first mesh 145) overlaid on one side of the coarse mesh 155 has openings 148 of a smaller size than the size of the openings 158. In this regard, the first mesh 145 and the second mesh 155 may be configured to offer acoustic resistances with different values. As will be appreciated, and for facilitating this description, the density of the fine mesh 145 and coarse mesh 155 may be exaggerated and as such some or all of the features of the mesh screen 142 may not be to scale. Furthermore, as described the tightness of the weave of each mesh and/corresponding sizes of the opening may be varied and the particular example depicted is provided for illustration purposes only. In some examples, the fine mesh (e.g. first mesh 145) or the coarse mesh 155 may have a density of the mesh which varies across one or more dimensions of the mesh. For example, the coarse mesh may be more dense in the middle portion 157 than other portions, such as the perimeter portion 159. The thickness and/or density of the fine mesh may be varied in a similar manner along a length or width of the fine mesh. As shown in FIG. 2D, the openings 158' of the mesh screen 142' may vary in size. Larger openings 161 may be located in a central portion 157' of the mesh screen 140' while smaller opening 163 may be located around the perimeter 159'. In other examples, the locations of the larger and smaller openings 161, 163 may be reversed or distributed according to any other pattern along the surface of the mesh screen 142'.

In some examples, the coarse mesh 155 may be formed from a plurality of metal strands or wires 156. The wires 156 may be implemented to have virtually any transverse cross section. In the context of this description the transverse cross section of the wires 156 is meant to be the cross section taken along the direction of the airflow (as shown by the arrows F in FIGS. 2A-2B). In some embodiments, one or more of the wires 156 may be circular in cross section. The size of the transverse cross section of one or more of the wires 156 may vary along the length of the wires. The transverse cross sectional shape may also vary. For example, a wire may be circular at the perimeter portion 159 and may be square or rectangular at a central portion. In other embodiments, one or more of the wires 156 may have a non-circular transverse cross section, such as a rectangular cross section. As will be understood, the rectangular wires may be oriented relative to the flow with the long side of the wires generally aligned with the direction of flow. In this manner, a stiffer mesh may be obtained while advantageously achieving lower values of acoustic resistance. The size and shape of the openings 158 and/or size and shape of the individual strands or wires 156 may be tailored in this manner to achieve different acoustic and/or structural performance at different portions of the coarse mesh 155. As described, the out-of-plane bending stiffness of the coarse mesh 155 may be varied from one portion to another portion of the mesh, while maintaining a nearly acoustically transparent profile of the mesh. Furthermore, stiffening the middle portion 157 of the mesh may also advantageously prevent second and/or third order vibrations of the mesh (see e.g., FIG. 2A).

The fine mesh 145 may be welded or bonded to the coarse mesh 155, for example using an adhesive, and the dual-layer mesh structure (e.g. mesh screen 142) may be coupled to the port 130 using an adhesive or other conventional fastening techniques. In some embodiments, the dual-layer mesh structure may be attached to the enclosure 120 using a mesh holder 160. The mesh holder 160 may be implemented as a pair of plates, each having an aperture 162 with a shape corresponding to the shape of the inlet 135. The dual-layer mesh may be placed across the aperture and retained between a pair of plates of the mesh holder 160. The mesh holder and dual-layer mesh secured thereto may be attached to the inlet using an adhesive, mechanical fasteners, or the like.

As will be understood, the specific examples of damping mechanisms 140 described herein are provided for illustration and are not to be taken in a limit sense and other variations are possible. For example, the damping mechanism 140 may be implemented as a single mesh screen, which is configured to provide the desired acoustic damping and stiffness when subjected to the pressure waves generated by the speaker. In some instances, the damping mechanism 140 may include a single, generally stiff mesh or grill with low acoustic resistance. The single mesh or grill may be coated with an acoustic damping material, for example by being sprayed with polyurethane foam (e.g. foam rubber) or any other soft polymeric material. The polymeric material sprayed or coated onto the grill may provide acoustic damping while the stiff understructure of the grill prevents flexing of the damping mechanism 140 under the loading of the pressure waves.

Figure 3A:
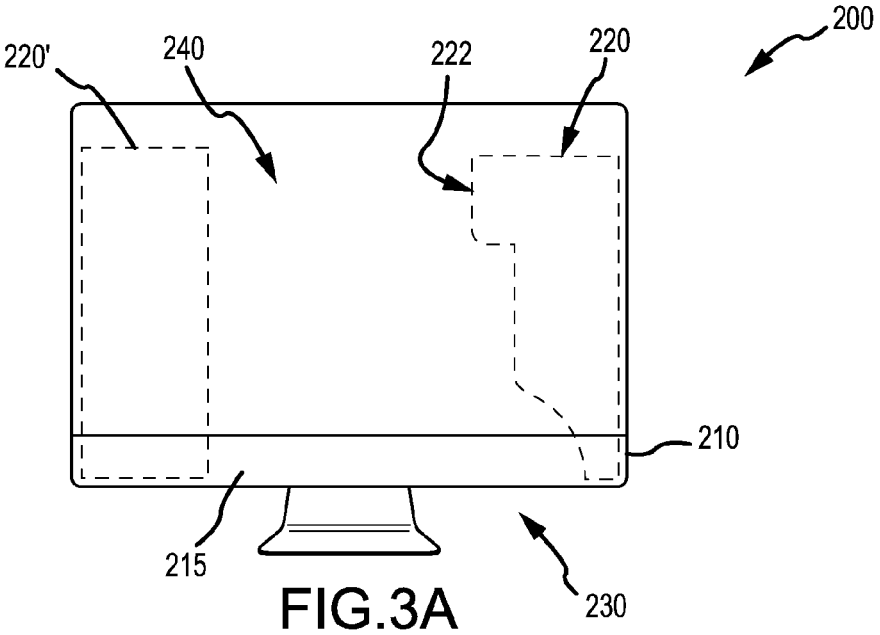
FIG. 3A is a front view of a computing device according to examples of the present disclosure.
Figure 3B:
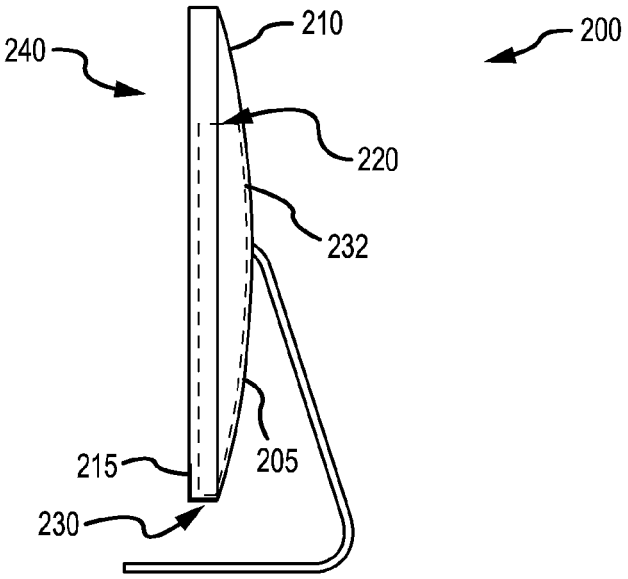
FIG. 3B is a side view of a computing device according to examples of the present disclosure.

FIGS. 3A-3B show an example of an electronic device according to embodiments of the present disclosure. The electronic device 200 may be a computing device, such as a desktop computer or a portable or laptop computer, a handheld media file player or smart phone, and the like. In other examples, the electronic device 200 may be a display device, such as an LCD, LED, or the like, or virtually any other device capable of outputting audio. The electronic device 200, in this example a computer, may include a housing 210 generally enclosing the internal components of the electronic device 200, including one or more speaker assemblies 220, 220'. The electronic device 200 may include other components as may be desired and known in the art, for example a display device 240 and internal circuitry (not shown). The housing 210 may include a speaker grill 230 with a plurality of openings for allowing the pressure waves generated by the one or more speakers 220, 220' to be delivered to the exterior of the device 200 and thereby to the user.

Figure 4:
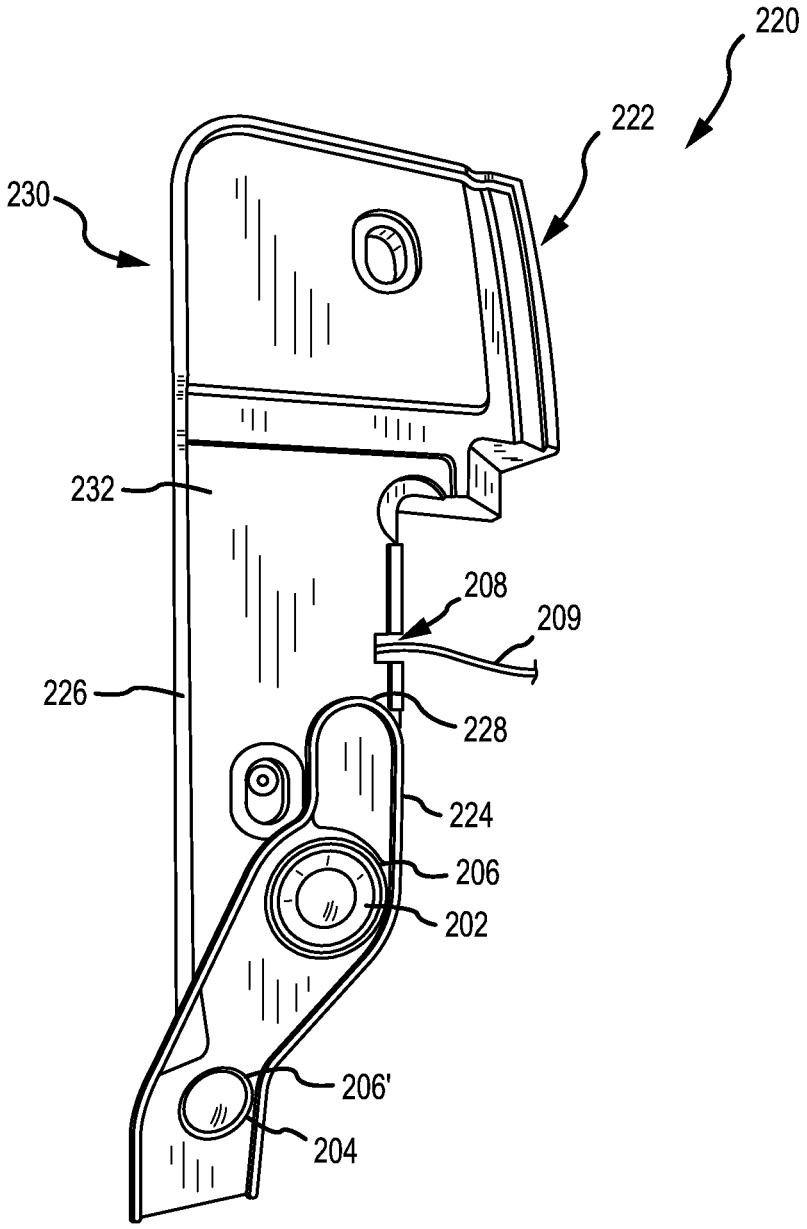
FIG. 4 is a top perspective view of a speaker assembly according to examples of the present disclosure.

FIG. 4 shows a speaker assembly 220 according to one example of the present disclosure. The speaker assembly 220 may include one or more speakers 202, 204 attached to a speaker enclosure 230 (also referred to as a duct), which may be molded from a rigid plastic, such as PC/ABS, or other suitable materials. In some examples, the speaker enclosure 230 may be configured as a generally rectangular box (see e.g., speaker enclosure 120 of FIG. 1). In other examples, the speaker enclosure or duct may have a complex shape, which may be customized to fit within a particular design space (see e.g. speaker enclosure 220). In some examples, it may be desirable to maximize the size and internal volume of the speaker enclosure 230. The size and shape of the enclosure 230 and/or location of the bass reflex port 222 may be selected based on the electrical and mechanical properties of the one or more speakers attached thereto. The speakers 202, 204 (also referred to herein as speaker units) may be selected from any conventional speakers, such as low frequency speakers (e.g. woofers), midrange, or high frequency speakers (e.g. a tweeters).

The one or more speakers 202, 204 may be incorporated into the speaker assembly 220 according to any of the examples of the present disclosure. For example, a first speaker 202 and/or a second speaker 204 may be mounted to the speaker enclosure 230 through speaker openings 206, 206'. With the speakers mounted to the enclosure, a generally closed chamber is defined inside the enclosure 230. As previously described, the enclosure 230 may include another opening 222 (e.g. a port or vent) which allows air or other medium to move in or out of the enclosure 230 when the speaker cones are oscillating responsive to the drivers. Signals may be transmitted to the drivers via one or more cables 209, which may pass through a hole 206 in the enclosure 230. In this regard, cable 209 penetrates the enclosure 230 to electrically couple the driver with electronics exterior of the enclosure. In some examples, the cable 209 may be secured against the enclosure 230, for example by being provided in a groove or channel formed along an exterior surface of the enclosure 230.

The speaker assembly 220 may be mounted to the housing 210 of the device 200 and arranged such that an exterior surface 232 of the enclosure is mounted against the back wall 205 of the housing 210 defining an enclosed space between the speaker and the housing. The speaker, which in this example faces the back wall 205 is provided in acoustic communication with the speaker grill 230. One or more sealing structures 224, 226, such as foam gaskets, may be used to seal the enclosure against the back wall 205. For example, the sealing structure 224 (e.g. foam gasket) may be attached to the surface 230 of the enclosure with a pressure sensitive adhesive (PSA) or another type of adhesive. According to some examples, and as further described below, one or more of the sealing structures may be adapted to aid with the installation of the speaker assembly 220 within the housing 210.

As previously described, the speaker enclosure 230 may include a port or vent 222 (e.g. a bass reflex port) which is spaced apart from the one or more speaker openings 206, 206'. As will be understood, the bass reflex port may allow pressure waves aft of the speaker cone to travel out of the speaker enclosure 210, enhancing certain aspects of the performance of the speaker assembly 220. The bass reflex port need not be coplanar or aligned in any manner relative to the speaker openings and/or speaker cones. In this regard, the bass reflex port can be formed through any one of the walls of the speaker enclosure 230. In the present example, the port 222 is provided through a side wall of the enclosure 230. Other locations may be used, in other embodiments.

Referring to the example shown in FIG. 4, the complexity of the shape of the duct 230 may introduce certain manufacturing challenges, for example making it more difficult to position the duct within the computer housing 210 without damaging sensitive speaker components in the process. As can be appreciated in light of the figures and this description, the duct 230 may need to be inserted in a narrow space defined between the back wall 205 and the chin 215 of the computer housing 210. As described, the speakers 202, 204 may be mounted to the duct 230 such that the speaker cones are exposed to possible contact during the assembly process. In some cases, the speaker cones may be delicate and even a slight pressure on the cone may cause it to collapse or be otherwise damaged. As such, it may be desirable to minimize or eliminate the risk of any other computer components, for example the housing 210, from coming into contact or scratching the speaker cones.

During assembly of the computer 210, the speaker assembly 220 may be slid into position between the back cover (e.g. back wall 205) and chin 210. However, while sliding the speaker assembly 220 in position, roughness or other features of the mating surfaces may cause the surfaces to tug against one another and may result in unintentional contact with one or more of the speaker cones. To address this problem, a friction reducing mechanism 228 may be used to ease the assembly process. The friction reducing mechanism 228 may be implemented as a lubricated layer applied to one or more surfaces of the sealing structure 224. In other examples, the friction reducing mechanism 228 may be a film of low-friction material, for example Mylar film, which may be adhered to the sealing structure 224. Other variations may be used for reducing the friction between the surface contacting and/or sliding against one another during the insertion of the speaker enclosure 230 within the computer housing 210.

Figure 5:
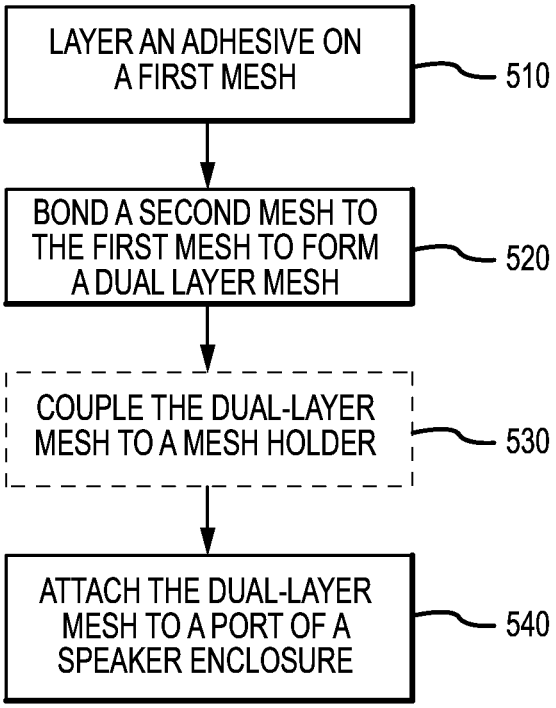
FIG. 5 is a flow diagram of a method of forming a speaker assembly according to examples of the present disclosure.

FIG. 5 shows a method for forming a speaker assembly according to some examples of the present disclosure. As shown in box 510, an adhesive may be layered on a surface of a mesh. The mesh may be a coarse mesh as described herein and configured to have acoustic resistance of up to 8 Rayls. The step of layering an adhesive may include spraying the adhesive or depositing a thin layer of the adhesive, for example by using conventional thin film deposition techniques. After the adhesive is layered on the surface of the coarse mesh, a fine mesh may be bonded thereto to form a dual-layer mesh, as shown in box 520. The step of bonding may include contacting the fine mesh to the coarse mesh, and in some instances applying a pressure to form a secure bond. The dual-layer mesh may be attached to a bass-reflex port of a speaker enclosure, as shown in box 540. For example, the dual-layer mesh may be adhered or fastened to a perimeter of the port. In other examples, an optional step of coupling the dual-layer mash to a mesh holder may be performed, as shown in dashed box 530, and the dual-layer mesh may then be attached to the vent using the mesh holder. The step of coupling the dual-layer mash to a mesh holder may include stretching the dual-layer mesh across an aperture of the mesh holder and retaining the dual-layer mesh between first and second plates of the mesh holder. Some of the step describe may be omitted or additional steps may be performed in some examples.

Figure 6:
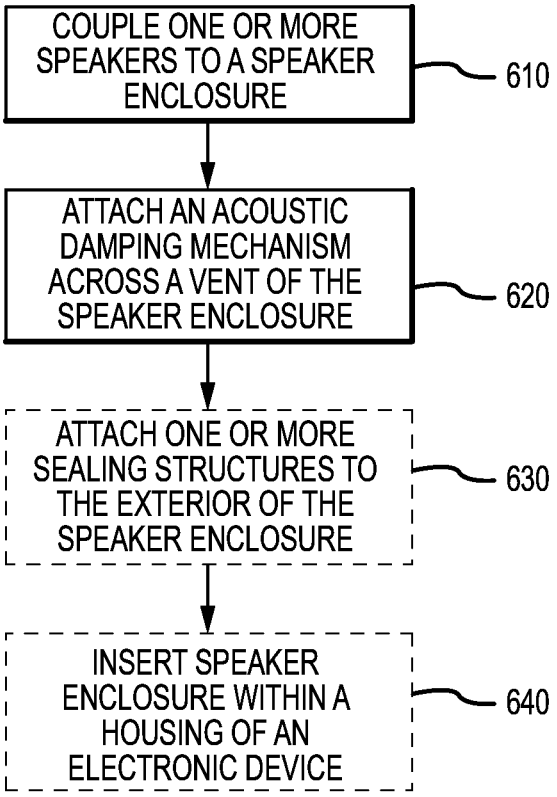
FIG. 6 is a flow diagram of a method of assembling a computing device according to examples of the present disclosure.

Referring now to FIG. 6, another method according to examples of the present disclosure will be described. As shown in box 610, one or more speakers may be coupled to a speaker enclosure. The one or more speakers may include speakers configured to reproduce sounds in the audible range, for example woofers, tweeters and/or midrange speakers. The step of coupling the one or more speakers may include providing connector cables through a hole in the speaker enclosure and/or securing the connector cable within a groove formed on an exterior wall of the speaker enclosure. The speaker enclosure in the present example may be ported, and a damping mechanism may be attached at the vent of the ported enclosure, as shown in box 620. The damping mechanism may be implemented according to any of the examples herein. In one embodiment, the damping mechanism may be a dual-layer mesh including first and second mesh layers having different acoustic resistance.

In a next step or simultaneously, one or more sealing structures, for example foam gaskets or acoustical damping panels or pads may be attached to certain portions of the exterior of the enclosure (see box 630), for example for the purpose of sealing the speaker against a housing of an electronic device. The step of attaching sealing structures may include applying a friction reducing layer onto at least one of said sealing structures. The friction reducing layers may be a Mylar film adhered to the sealing structure or a lubricant applied to a surface of the sealing structure. The speaker assembly (e.g. enclosure, speakers, and other components attached thereto) may then be inserted into and attached to the housing of the electronic device, as shown in box 640. As will be appreciated, additional steps may be added and one or more of the steps recited above may be performed out of sequence or omitted altogether without departing from the scope of the present invention.

While various aspects and examples have been disclosed herein, other aspects and examples will be apparent to those skilled in the art. The various aspects and examples disclosed herein are for purposes of illustration and are not intended to be limiting, with the true scope and spirit being indicated by the following claims.

We claim:

1. A speaker assembly, comprising:

a speaker enclosure forming a back volume chamber and having walls defining a vent opening;

a speaker unit; and a layer of mesh material extending across the vent opening, the layer of mesh material including a first region and a second region, the first region being closer to the walls defining the vent opening than the second region, wherein the vent opening is configured to allow passage of pressure waves generated by the speaker unit to exit the speaker enclosure and wherein the first region has a first acoustic resistance and the second region has a second acoustic resistance different than the first acoustic resistance.

2. The speaker assembly of claim 1, wherein the first acoustic resistance ranges from about 16 Rayls to about 75 Rayls, and wherein the second acoustic resistance ranges from about 1 Rayl to about 8 Rayls.

3. The speaker assembly of claim 1, wherein the speaker mount opening is positioned on the same side of the speaker enclosure as the vent opening.

4. The speaker assembly of claim 1, wherein the layer of mesh material is made of a plurality of metal wires, and wherein one or more of the wires have a rectangular transverse cross section.

5. The speaker assembly of claim 1, wherein the layer of mesh material is made of a plurality of metal wires, and wherein a cross-sectional shape or size of one or more of the metal wires varies along a length of the plurality of metal wires.

6. The speaker assembly of claim 1, wherein a thickness of the layer of mesh material varies along a length of the layer of mesh material.

7. The speaker assembly of claim 1, wherein a mesh density of the layer of mesh material varies along a length of the layer of mesh material.

8. The speaker assembly of claim 1, wherein acoustic resistance of the mesh screen varies along a length of the mesh screen.

9. A damping mechanism configured to cover an opening defined by walls of a speaker enclosure, comprising:

a layer of mesh material extending across the opening, comprising:

a first mesh region corresponding to a central portion of the layer of mesh material and having a first acoustic resistance; and a second mesh region corresponding to a perimeter portion of the mesh screen at least partially surrounding the first mesh region and having a second acoustic resistance that is different than the first acoustic resistance, wherein the second mesh region is closer to the walls defining the opening than the first mesh region.

10. The damping mechanism of claim 9, wherein:

the first mesh region has first mesh density; and the second mesh region has a second mesh density that is different than the first mesh density.

11. The damping mechanism of claim 10, wherein the second mesh density is greater than the first mesh density.

12. The damping mechanism of claim 9, wherein:

the first mesh region has first thickness; and the second mesh region has a second thickness that is different than the first thickness.

13. The damping mechanism of claim 9, wherein the layer of mesh material comprises:

a first layer of mesh configured to provide acoustic damping; and a second layer of mesh configured to limit out-of-plane bending of the first layer of mesh when the first layer of mesh is subjected to pressure waves from a speaker coupled to the speaker enclosure.

14. The damping mechanism of claim 13, wherein:

the first layer of mesh has a first acoustic resistance and a first stiffness; and the second layer of mesh has a second acoustic resistance that is lower than the first acoustic resistance and a second stiffness that is higher than the first stiffness.

15. A speaker assembly, comprising:

a speaker enclosure having walls defining an opening in the speaker enclosure; and a layer of mesh material extending across the opening, the layer of mesh material comprising:

a first mesh region having a first acoustic resistance; and a second mesh region having a second acoustic resistance that is different than the first acoustic resistance, wherein the second mesh region is closer to the walls than the first mesh region.

16. The speaker assembly as recited in claim 15, wherein an average size of openings defined by the first mesh region is larger than an average size of openings defined by the second mesh region.

17. The speaker assembly as recited in claim 15, wherein the layer of mesh material is a first layer of mesh and wherein the damping mechanism further comprises a second layer of mesh configured to limit out-of-plane bending of the first layer of mesh when the first layer of mesh is subjected to pressure waves from the speaker.

18. The speaker assembly as recited in claim 15, wherein the first region is positioned within a central portion of the layer of mesh material and the second region is positioned along a periphery of the layer of mesh material.

* * * * *